US007559099B2

(12) United States Patent
Epshetsky et al.

(10) Patent No.: US 7,559,099 B2
(45) Date of Patent: Jul. 14, 2009

(54) METHOD AND SYSTEM FOR PROVIDING CONVENIENTLY ACCESSIBLE RESTING AREA

(76) Inventors: Yefim Epshetsky, 1525 Commodore Ct., Unit 5, Schaumburg, IL (US) 60193; Svetlana Lapan, 3659 Oak Ave., Northbrook, IL (US) 60062; Leonid Shmagin, 25522 W. Foxtail Rd., Round Lake, IL (US) 60073

( * ) Notice: Subject to any disclaimer, the term of this patent is extended or adjusted under 35 U.S.C. 154(b) by 0 days.

(21) Appl. No.: 11/686,761

(22) Filed: Mar. 15, 2007

(65) Prior Publication Data

US 2008/0222810 A1 Sep. 18, 2008

(51) Int. Cl.
*A47D 7/04* (2006.01)
*A47D 7/00* (2006.01)

(52) U.S. Cl. ..... 5/95; 5/662; 5/507.1; 5/513

(58) Field of Classification Search ..... 5/95, 5/101, 103, 104, 662, 503.1, 507.1, 513, 5/905; 119/28.5
See application file for complete search history.

(56) References Cited

U.S. PATENT DOCUMENTS 562,321 A * 6/1896 Ranney ..... 5/95
591,095 A * 10/1897 Evans ..... 297/62
1,012,737 A * 12/1911 Solomon ..... 5/95
RE13,719 E * 4/1914 Taylor ..... 5/99.1
1,133,429 A * 3/1915 Christensen ..... 5/95
1,432,383 A * 10/1922 Comings ..... 5/513
2,406,447 A * 8/1946 Waters ..... 5/95
3,854,155 A 12/1974 Picard
3,868,734 A 3/1975 Benoit et al.
3,882,554 A 5/1975 Glass
3,952,342 A 4/1976 Hart
4,020,510 A 5/1977 Fabian
4,286,525 A 9/1981 Willmore
4,375,707 A 3/1983 Boerigter
4,377,011 A 3/1983 Kimberger
4,686,727 A * 8/1987 Wilkinson ..... 5/503.1
4,837,877 A 6/1989 Hamada et al.
4,922,561 A * 5/1990 Williams ..... 5/9.1
5,095,563 A 3/1992 Miller
5,187,826 A 2/1993 Mariol
5,263,210 A 11/1993 Pollard
5,363,520 A 11/1994 Lyne, Jr.
5,502,850 A 4/1996 Lyne, Jr.

(Continued)

*Primary Examiner*—Michael Trettel
(74) *Attorney, Agent, or Firm*—Law Office of Marc D. Machtinger, Ltd.

(57) ABSTRACT

A method and apparatus for providing a resting area for an infant or a pet is disclosed. The resting area includes a support structure and a holding structure for holding the resting area over, or at least partially above an adult sleeping area. This enables the resting area to be easily accessible to an adult located in the adult sleeping area. The resting area is optionally movable in various manners, such as vertically, horizontally, rotatably, and swingably. The apparatus may include a horizontal arm extending from a support frame. A sleep divider is optionally provided in order to enable one adult to attend to an infant or pet while decreasing the disturbance to another adult on the opposite side of the divider. Various additional optional features may include providing heating means to a portion of the rest area, a convenient supply tray, lighting means, and various holding structure configurations for convenience and comfort.

29 Claims, 6 Drawing Sheets

U.S. PATENT DOCUMENTS 5,681,018 A 10/1997 Hoftman
5,819,340 A * 10/1998 Kelly ..... 5/95
5,943,714 A 8/1999 Dignam
6,112,347 A 9/2000 Tharalson et al.
6,507,962 B2 1/2003 Thurston
6,698,040 B1 3/2004 Acevedo
7,032,522 B2 4/2006 George et al.

* cited by examiner

METHOD AND SYSTEM FOR PROVIDING CONVENIENTLY ACCESSIBLE RESTING AREA

BACKGROUND OF THE INVENTION

1. Field of the Invention

The present invention relates to resting places for infants or pets, and more specifically, to resting place positioned above an adult sleeping area.

2. Description of the Related Art

Many parents of infants desire a co-sleeping arrangement. Co-sleeping is often characterized by the infant sharing the same bed as the parent. Supporters of co-sleeping believe that co-sleeping encourages breastfeeding by making nighttime breastfeeding more convenient and facilitates the nursing mother to sync her sleep cycle with that of her baby. Additionally, co-sleeping advocates suggest that co-sleeping helps babies fall asleep faster and get more nighttime sleep. Co-sleeping is also said to help parents bond with the infant.

However, the U.S Consumer Product Safety Commission, along with the American Academy of Pediatrics, warns parents not to place their infants to sleep in adult beds. These organizations state that the practice of co-sleeping puts babies at a higher risk of suffocation and strangulation. According to the U.S. Consumer Product Safety Commission the primary risks of infants sleeping in adult beds include suffocation caused by an adult rolling on top of or next to a baby; suffocation when an infant gets trapped or wedged between a mattress and a headboard, nightstand, wall, or other object; suffocation resulting from a baby being face down on a waterbed, a regular mattress or on soft bedding, such as pillow blankets, or quilts; and strangulation in a headboard or footboard that allows a portion of an infant's body to pass through an area while trapping the baby's head.

To avoid these risks, there are ways to keep a baby close by, but not in the adult's bed. For example, a baby can be placed in a bassinet or crib next to the adult's bed. There are also devices that look like a bassinet minus one side, which attaches to the adult bed. These devices allow the parent and baby to be next to one another without the possibility of the parent rolling over onto the infant. A bedside co-sleeper of this type is disclosed in U.S. Pat. No. 6,112,347, issued Sep. 5, 2000, to Tharalson, et al.

Unfortunately, many rooms do not have enough space to place these devices in the same room as the adult bed, let alone at the side of the adult bed. When used, a bassinet placed next to a bed will be inconvenient in that only one adult on one side of the bed will have convenient access to it. Additionally, when a bassinet is placed near the side of the bed, this can block easy access to the bed and make it difficult for an adult to move in or out of the bed. Furthermore, these solutions do not optimize the adult's convenience in caring for an infant. Accordingly there remains a need for a device that brings the infant in close proximity to the adult bed without the risks associated with co-sleeping and without taking up valuable space in the room.

There are a variety of bed designs known where a bed surface is retractable or can otherwise be hidden to maximize space utilization. For example, U.S. Pat. No. 3,882,554, issued on May 13, 1975, to Glass discloses a retractable bed having a frame with a pair of legs standing against opposite walls of a room and horizontal room spanning members extending between tops of the legs against the ceiling of the room. In Glass, there is a bed platform with four retracting lines slidably extended from the corners of the bed platform upward to the horizontal members, along the horizontal members, and downward at one pair of legs. Also in Glass, there is a counterweight adjacent to a pair of legs attached to the retracting lines. There are also four support lines extending from the corners of the bed platform, over pulleys at the top of the legs. There are also slack take-up weights at the end of the support lines.

Other retractable beds are also known. U.S. Pat. No. 6,698,040, issued Mar. 2, 2004, to Acevedo, discloses a powered retractable bed. U.S. Pat. No. 5,502,850, issued Apr. 2, 1996, to Lyne, Jr., disloses a space-saving bed. U.S. Pat. No. 5,943,714, issued Aug. 31, 1999, to Dignam, discloses a suspended sleep platform assembly. U.S. Pat. No. 5,363,520, issued Nov. 15, 1994, to Lyne, Jr., discloses another space-saving bed. U.S. Pat. No. 4,837,877, issued Jun. 13, 1989, to Hamada et al., discloses a powered elevation bed. U.S. Pat. No. 5,263,210, issued Nov. 23, 1993, to Pollard, discloses another space-saving bed. U.S. Pat. No. 6,507,962, issued Jun. 21, 2003, to Thurston, discloses a ceiling mounted sleeping system.

There are also various bars or arms supporting an object over a hospital bed. For example, U.S. Pat. No. 4,020,510, issued May 3, 1977, to Fabian discloses a hospital bed accessory for supporting a desk like platform within reach of a patient, especially one who has to lie prone on the bed, so that the patient can reach the platform and read or write thereon, and move the platform out of the way when desired. According to Fabian, the accessory includes a vertical main post clamped to a headboard of the bed, and a horizontal radial arm extending out from the main post over the bed. A depending second post is suspended from the outer end of the radial arm so as to bring the desk-like platform suspended from its lower end within reach the patient. U.S. Pat. No. 3,868,734, issued Mar. 4, 1975, to Benoit et al., discloses a hospital exercise bar. U.S. Pat. No. 4,375,707, issued Mar. 8, 1983, to Boerigter, discloses an invalid bed having a frame and an overhead support structure which provides an elevated diagonally extending support surface for a pivot arm.

Various other sleeping or play areas for infants are known. However, there remains a need for a space-saving device that provides the benefits of co-sleeping without the associated risks. Specifically, there remains a need for a method and apparatus which provides a convenient resting area above an adult sleeping area such as a bed.

Additionally, there are situations in which it would be considered desirable to have a rest area for a pet, such as a cat or dog or other household animal, positioned over a bed. The advantages include eliminating inconveniences associated with an animal sleeping directly on the adult bed, and ease of care and providing affection. There remains a need for a method and apparatus to provide the ability to enable such a resting place for an infant or for a pet.

SUMMARY

In view of the deficiencies described above, it is an object of the present invention to provide a resting area for an infant or a pet over an adult sleeping area. It is a further object of the present invention to provide a convenient resting area for an infant or a pet having various features and advantages.

The present invention is a method and apparatus for providing a resting area for an infant or a pet above an adult sleeping area. The invention includes a holding structure for holding the infant or pet. The holding structure may take on various forms such as a cradle, bassinet, car seat, swing, or other suitable structure. The holding structure is supported above, or at least partially above, an adult sleeping area such as a bed. The holding structure is supported by a support structure.

Various degrees of movement are provided to enable the holding structure to be conveniently accessed during durations of attending to an infant or pet, as well as placed in a resting position during resting periods. In various embodiments, the holding structure is capable of being moved vertically, horizontally, rotatably, or swingably. In certain embodiments, a support arm extends from a support stand. The support arm may be moved about a pivot point. The holding structure may be moved radially with respect to the arm.

Various other optional features and advantages include a sleep divider extending from the arm such that one parent might attend to an infant without disturbing another parent. A light source may be provided to illuminate an area during use. A convenient tray may be incorporated to provide a convenient area to keep supplies. A heating source may be used to heat the holding structure for the comfort of an infant or pet.

In its various embodiments, the holding structure may be conveniently formed to enable easy access to the infant or pet. Collapsible walls, folding walls, and flexible surfaces are optionally used to increase the utility of the apparatus. The structure ideally avoids the problems associated with using a bedside bassinet, in that access to the bed is not hindered, and access to the holding structure is not limited to one side of the bed.

Other features and advantages of the invention will be apparent from the following detailed description taken in conjunction with the following figures, wherein like reference numerals represent like features.

DETAILED DESCRIPTION OF THE INVENTION

Figure 1:
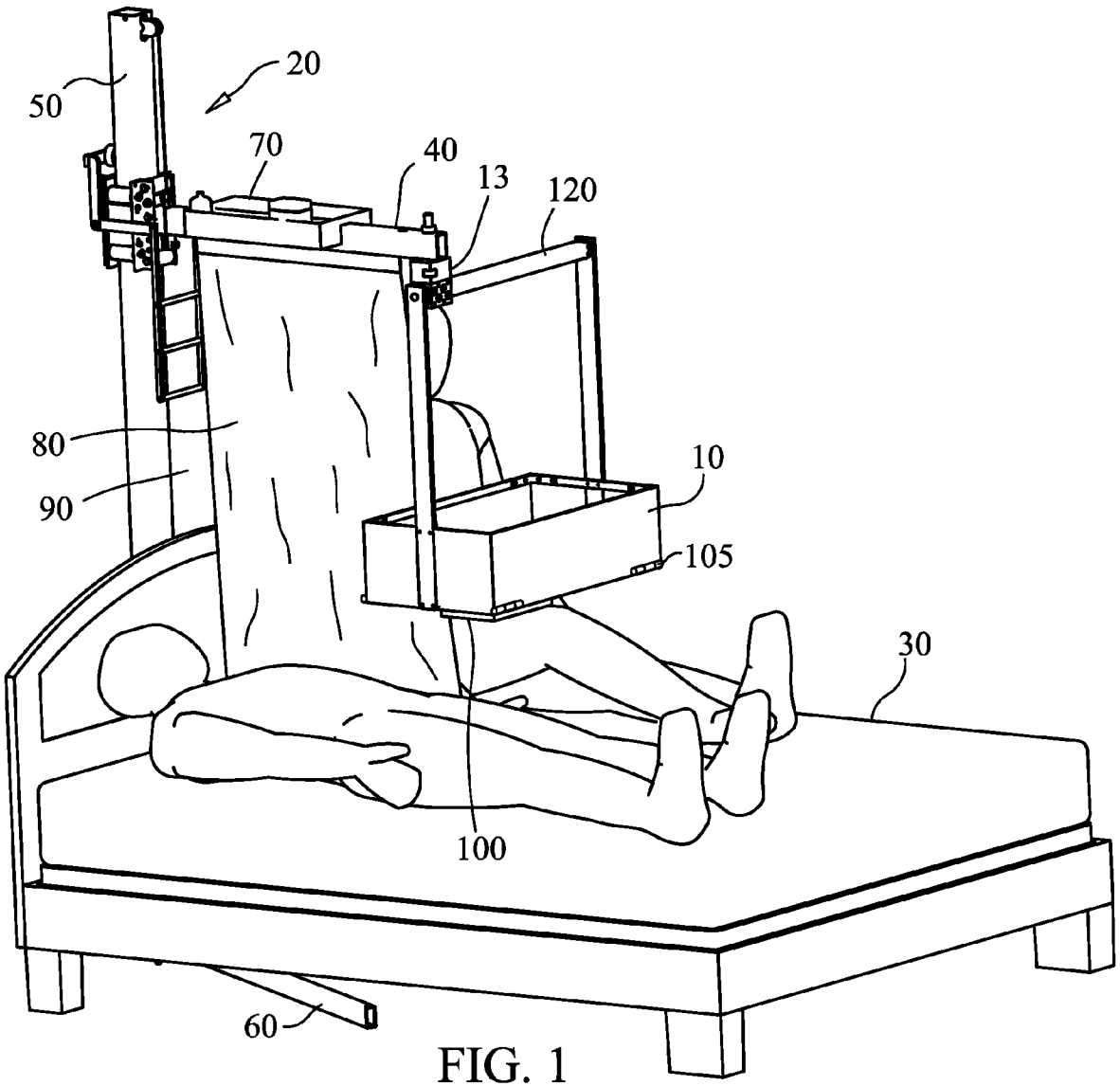
FIG. 1 is a perspective view of the apparatus of the present invention showing the holding structure in one of its possible positions.

While this invention is susceptible of embodiments in many different forms, there are shown in the drawings and will herein be described in detail, preferred embodiments of the invention with the understanding that the present disclosure is to be considered as an exemplification of the principles of the invention and is not intended to limit the broad aspect of the invention to the embodiments illustrated.

In various embodiments, the present invention is a method and an apparatus for providing an accessible resting place for an infant or a pet above an adult sleeping area.

The method of the present invention includes providing a holding means 10 for holding an infant or a pet, and providing a support structure 20 for supporting the holding means 10 in an elevated position at least partially disposed above an adult sleeping area 30. The holding means 10 is a holding structure 10 of any suitable means to hold a pet or an infant. It may include a cradle, bassinette, car seat, swing, or fabric container, or any other suitable holding structure. Ideally, the holding structure 10 can be reached by an adult so that the infant or pet can be attended to while the adult is positioned in the adult sleeping area 30. Thus, for example, a parent caring for an infant could rest during intervals between child-care activities, and attend to the infant without having to leave the resting area 30.

In a preferred embodiment, the method includes providing the holding means 10 capable of being selectively moved from at least a first position to a second position vertically. This movement can occur in any suitable manner. Thus, the holding structure 10 can be moved up and out of the way while an infant, for example, is sleeping, and can be moved down into a position which is convenient for an adult to attend to it. In the lower position, the holding structure 10 may even rest upon the lap of an adult.

Preferably, the holding structure 10 is movable in the X-Y plane, meaning the horizontal plane. This movement could occur between two or more fixed positions, or throughout a continuum of positions. Thus, the holding structure 10 can preferably be moved to various convenient positions for attending to the infant or pet, and to various positions in which it is moved out of the way for resting periods.

The horizontal movement can be enabled in various alternative manners. Any structure suitable for such movement is contemplated, however, in one such design, the support structure 20 may include a horizontal arm 40 extending from a support stand 50. The support stand 50 may be supported by legs 60. The arm 40 extends over the adult sleeping area 30 and supports the holding structure 10 at or near its distal end. The arm 40 may be pivotally movable about the support stand 50 to enable horizontal movement of the holding structure. Furthermore, the arm 40 preferably would enable the holdings structure 10 to move radially along the arm 40. In such a configuration, the holding structure 10 could be moved in substantially any horizontal direction.

Preferably, the holding structure 10 is capably of various other degrees of movement. For example, the holding structure 10 may be rotatably movable about a vertical axis. It may also be capable of a swinging motion back and forth, and the swinging amplitude may be adjustable. This may be particularly useful to sooth a crying infant.

In various preferred embodiments, additional optional features are contemplated within the scope of the invention. For example, a tray 70 may be included to provide a convenient place for various supplies to be kept, such as supplies needed to attend to the infant or pet. Such a tray 70 may be supported by arm 40. Optionally, a sleep area divider 80 may be provided to reduce the disturbance to a second adult using the adult sleeping area 30. The sleep area divider 80 may extend from the arm 40, and may be a curtain or other suitable divider. This divider 80 may also be retractable.

Preferred embodiments of the present invention may also include a light source 90 to light an area over the adult sleeping area 30 to assist an adult caring for a pet or infant. Optionally, the holding structure 10 may be equipped with a heating means 100 such as an electrical heating pad.

The apparatus of the present invention, in its various embodiments, includes structure to enable the above-disclosed method. Thus, described in this manner, the apparatus of the present invention is a resting area for an infant or a pet. A holding structure 10 is supported by a support structure 20, at least partially if not completely above an adult sleeping area 30.

The holding structure 10, as explained, may be any suitable structure for holding an infant or a pet. The holding structure 10 is preferably vertically movable. Preferably, the vertical movement would allow the holding structure 10 to be adjustable between at least two vertical positions. Preferably, the holding structure 10 is additionally movable in the horizontal plane, thus enabling a variety of positions.

A rotating arm 40 extending from the support stand 50 is also preferable. The arm 40 preferably rotates about a pivot point at the support stand 50, enabling a range of horizontal motion. In various preferred embodiments, various degrees of motion can be enabled using numerous structural designs. One example includes allowing the holding structure 10 to be rotatable about a vertical axis. Another includes enabling the holding structure 10 to swing, such as via supports 110 or via rod 120.

Figure 6:
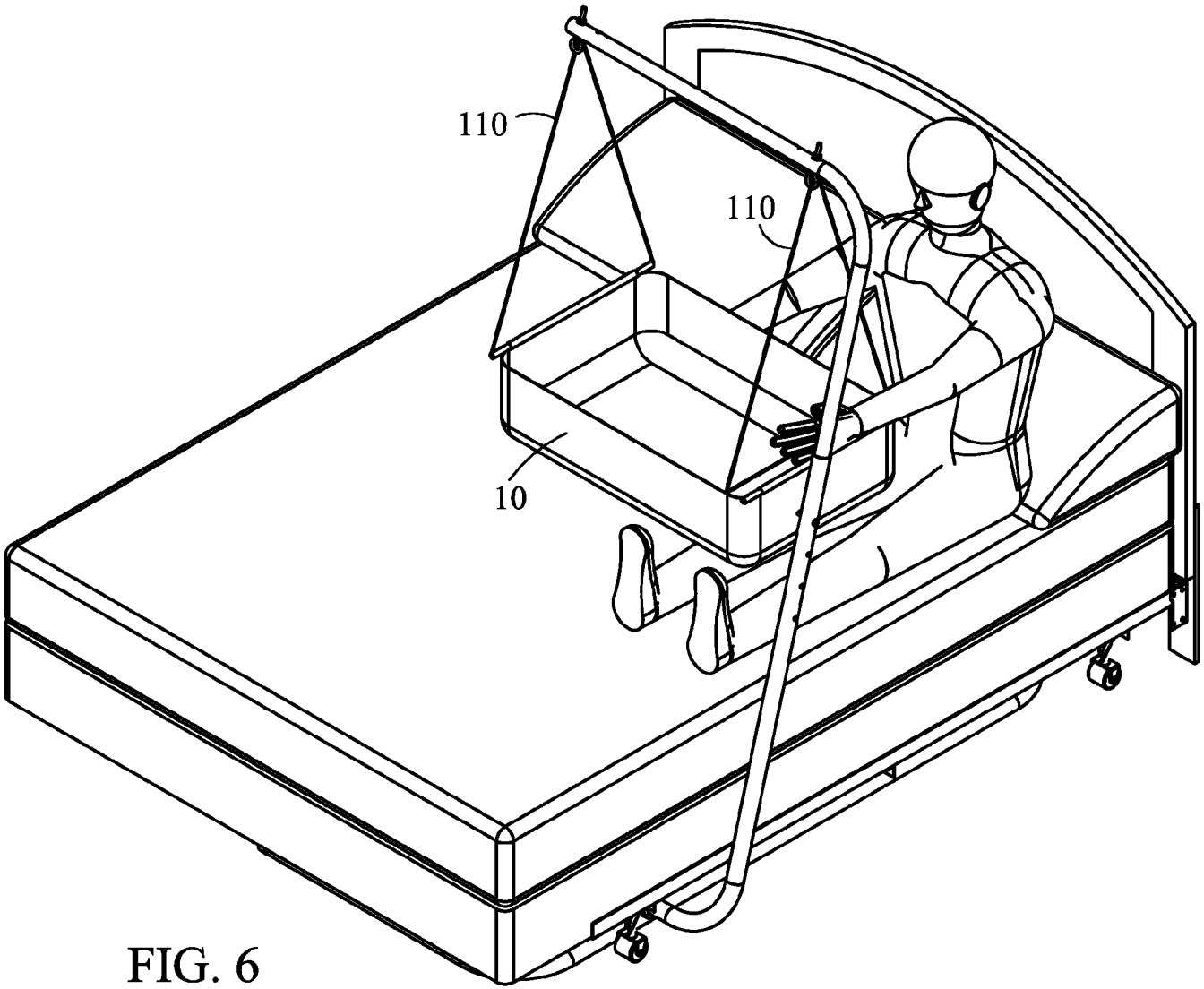
FIG. 6 is a perspective view showing one embodiment of the apparatus of the present invention which enables swinging movement of the holding structure.

Another preferred embodiment is shown in FIG. 6. The holding structure 10 is supported by a "C-shaped" apparatus which extends from below the bed upward, and over the adult bed area. In this embodiment, the holding structure 10 is pivotably movable about a pivot at the base of the bed. Stops may be included which would conveniently enable the holding structure 10 to be positioned in at least two positions. For example, the holding structure 10 may be positioned in a service position which would place it over the lap of an adult. The adult is then able to pivot the apparatus to shift it toward the foot of the bed so that it is out of the way. In the latter position, the holding apparatus 10 may be vertically raised as well since the pivot would be more aligned vertically with the top of the apparatus in that position. This would enable the adult to sleep with the holding structure 10 in a position which would not be a hinderance.

Figure 2:
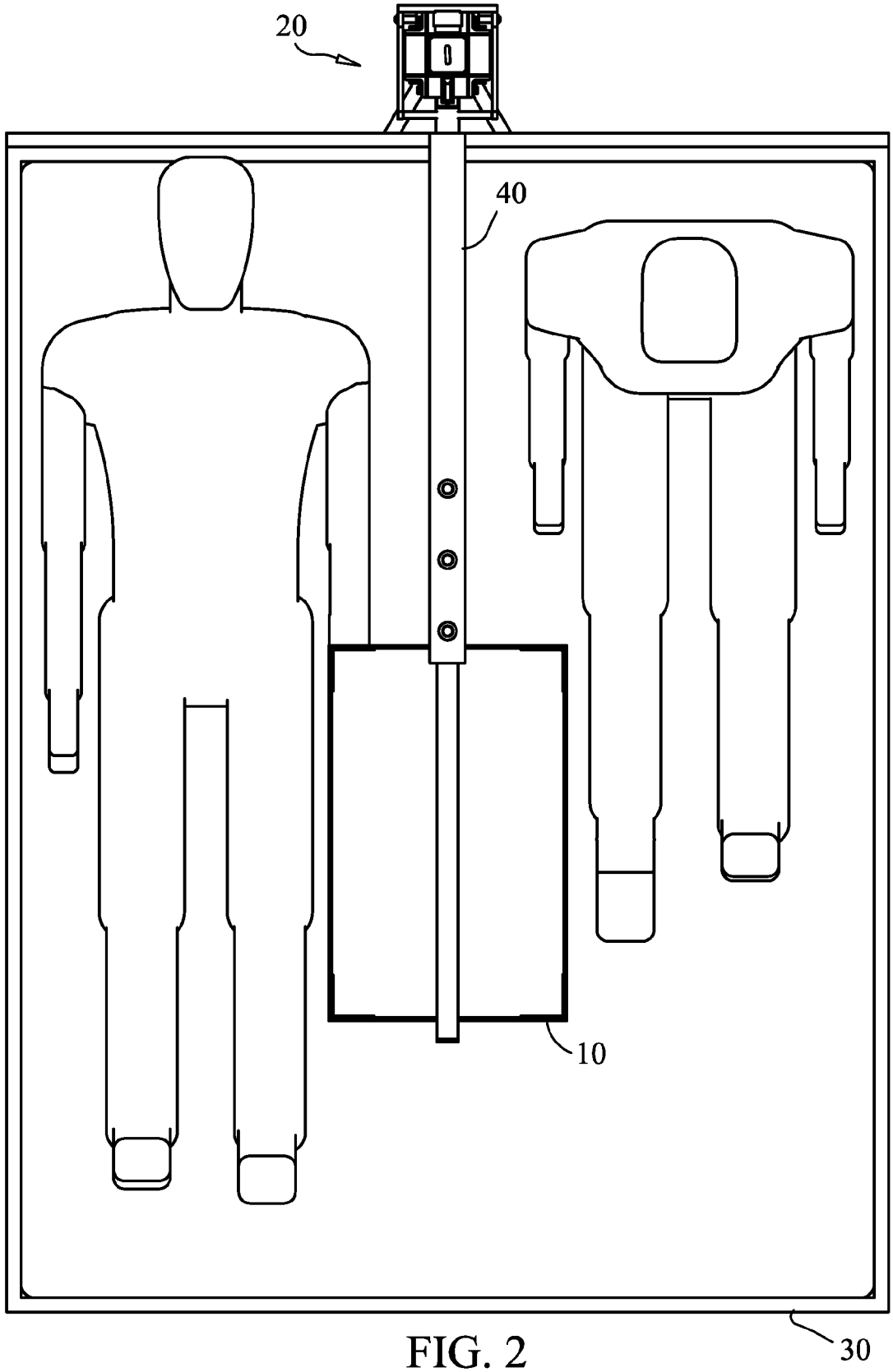
FIG. 2 is a top view of the apparatus of the present invention showing the holding structure in a parallel position.

In various preferred embodiments, the holding structure 10 is supported via a support rod 120. The support rod 120 is held by receiving means 130. Preferably, receiving means 130 allows rod 120 to slide within it horizontally, and optionally pivotally move as well. Thus, the holding structure 10 can be moved to one side or the other of the adult sleeping area 30, or to a parallel position in the center of the adult sleeping area 30 as shown in FIG. 2.

Figure 3:
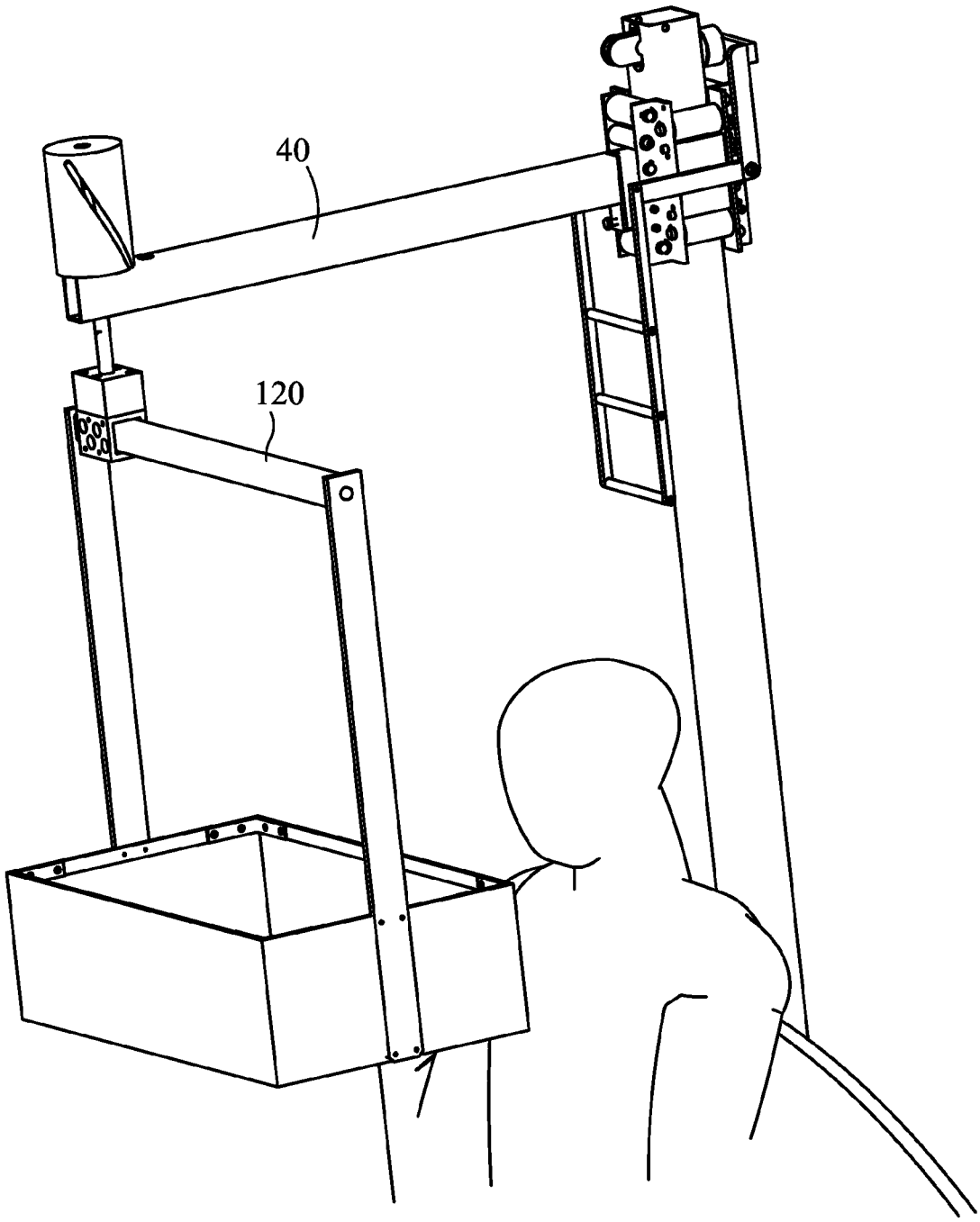
FIG. 3 is a perspective side view of the apparatus of the present invention showing various possible mechanism for allowing movement.
Figure 4:
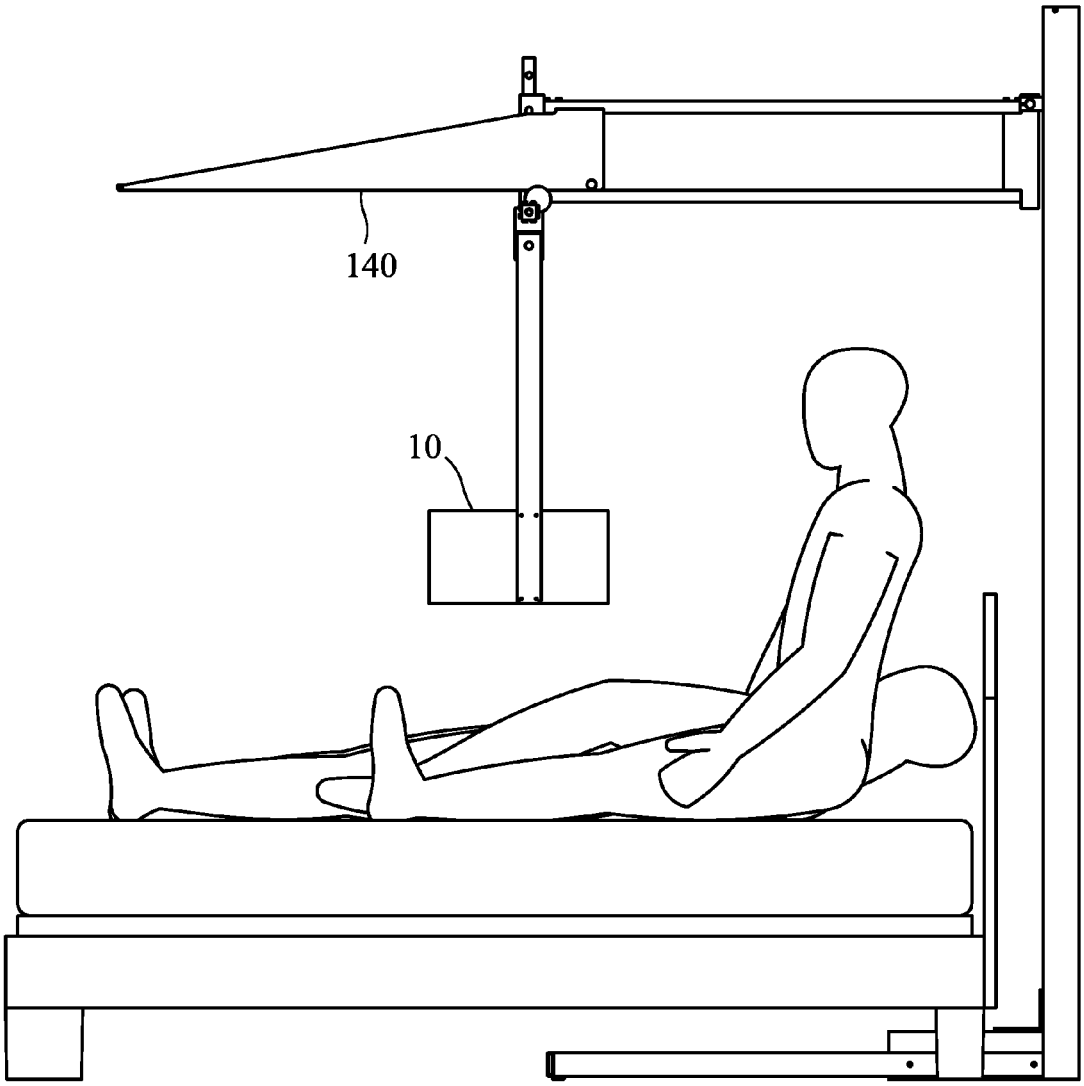
FIG. 4 is a side view of the apparatus of the present invention showing the holding structure in a raised position.
Figure 5:
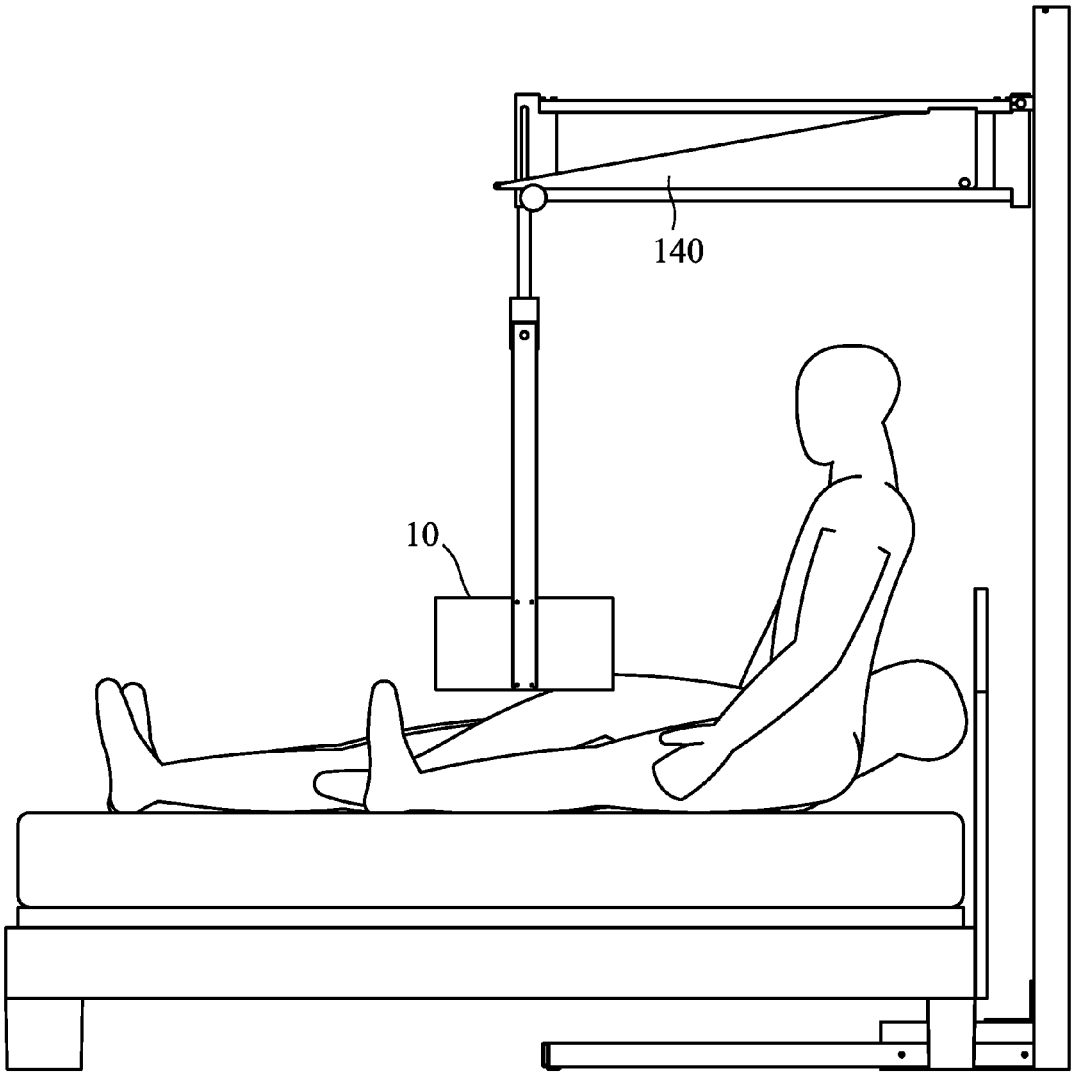
FIG. 5 is a side view of the apparatus of the present invention showing the holding structure in a lowered position.

In other various preferred embodiments, the structure of the support structure 20 may enable particularly convenient modes of adjustment, such as is shown in FIGS. 4 and 5. A cam or wedge 140 operates to produce vertical movement of the holding structure 10 when the user causes horizontal movement. Thus, in a single motion, the holding structure 10 can be moved up and out of the way. FIG. 3 also shows optional structure to enable various degrees of motion including horizontal motion, vertical motion, and pivotal movement.

The apparatus of the present invention optionally includes various features as described with respect to the associated method above. For example, a tray 70 may be included, a light source 90 may be included, and a sleep divider 80 such as a retractable divider may be included. Additionally, a heating means 100 may be included to enable heating of the holding structure 10.

The apparatus of the present invention optionally includes various convenient structural options for the holding structure 10. In one optional embodiment, the holding structure 10 includes flaps which extend below the bottom surface of the holding structure 10. In this fashion, the flaps can enclose an air pocket underneath the holding structure 10 which can retain heat from an infant or from the adult underneath, thereby keeping the holding structure 10 warm. Such flaps would preferably be composed of fabric or some flexible material.

The holding structure 10 preferably has a structure which provides for easy access by the adult. For example, in various preferred embodiments, one or more side walls may be collapsible or may have the ability to fold down, such as via hinges 105. Thus, the adult could lower the holding structure 10 and fold down a wall to obtain convenient access to the holding structure 10. In other preferred embodiments, the holding structure 10 includes an upper rim which is rigid, and collapsible walls. Thus, when the holding structure 10 is lowered onto an adult's lap, for example, the bottom surface can raise with respect to the upper rim, thus bringing an infant to a level unobstructed by the walls and upper rim.

In another preferred embodiment, the holding structure 10 may include a bottom rim which is rigid, and the upper rim may be lowerable via collapsible walls or other structure which enables the upper rim to be lowered with respect to the bottom rim. Thus, unobstructed access is again obtained to the infant.

A heating source 100 is optionally provided to a portion of the holding structure 10. Thus, the bottom surface or other portion of the holding structure can be heated to a desired temperature for the comfort of the infant or pet. A device with a heating elements, such as an electrical heating pad may be utilized for this purpose. However, other suitable heat sources are contemplated within the scope of the present invention.

In another preferred embodiments, the holding structure 10 of the present invention includes a structure which allows for the adjustment of the shape of the bottom surface. The bottom surface is ideally a flexible material, which becomes distorted when an infant or a pet is disposed atop the bottom surface. The depth and angles of the side areas of the bottom surface may be adjustable by adjusting their place of attachment on the holding structure to optimize the holding structure 10 for particular purposes. One advantage of flexible material being used for the bottom surface in various embodiments is that the adult can touch or rub an infant or pet through the bottom surface to provide heat or affection or comfort.

The support structure 20 may be composed of any suitable material. Preferably, a sturdy metallic structure, such as aluminum, brass, or steel would be used. The support structure 20 may include a sturdy stand 50 which enables the arm 40 to be raised or lowered. The stand 50 would preferably be supported by legs 60. Such legs 60 can extend under the sleeping area 30 such that the center of gravity of the system is positioned over the legs. Alternatively, the support structure 20 can optionally be attached to a wall, ceiling, or bed frame.

While specific embodiments have been illustrated and described, numerous modifications come to mind without significantly departing from the spirit of the invention and the scope of protection is limited by the scope of the accompanying claims

What is claimed is:

1. A method for providing an accessible resting place for an infant or a pet above an adult sleeping area comprising the steps of:

providing a holding means with a horizontal surface having an area substantially smaller than said adult sleeping area for holding an infant or a pet, providing a support structure for supporting said holding means in an elevated position at least partially disposed above an adult sleeping area, wherein said holding means is movable via a single step operation from a first position to a second position displaced both horizontally and vertically from said first position and wherein said horizontal surface is substantially horizontal throughout said single step operation.

2. The method for providing an accessible resting place according to claim 1, wherein said holding means is disposed in a position which can be reached by an adult from the adult sleeping area.

3. The method for providing an accessible resting place according to claim 1, wherein said support structure enables said holding means to be selectively moved from at least a first position to a second position vertically.

4. The method for providing an accessible resting place according to claim 3, wherein said first position is a position in which said holding means enables holding an infant or pet in an elevated position above said adult sleeping area, and wherein said second position is a lower position which enables an adult to have easy access to said holding means.

5. The method for providing an accessible resting place according to claim 4, wherein said support structure enables said holding means to be selectively moved from at least a first X-Y plane position to at least a second position horizontally displaced from said first X-Y plane position.

6. The method for providing an accessible resting place according to claim 5, wherein said support structure enables movement of said holding means in substantially any direction within the X-Y plane.

7. The method for providing an accessible resting place according to claim 6, wherein said holding means is rotatably movable about a vertical axis.

8. The method for providing an accessible resting place according to claim 7, wherein said holding means is swingably movable.

9. The method for providing an accessible resting place according to claim 4, wherein said support structure comprises a substantially horizontal arm for supporting said holding means.

10. The method for providing an accessible resting place according to claim 9, wherein said arm supports a substantially horizontally positioned tray for holding supplies.

11. The method for providing an accessible resting place according to claim 9, wherein said arm supports a vertical sleep area divider extending from said arm down to said adult sleeping area.

12. An apparatus for providing a resting area for an infant or a pet comprising:

a holding means with a horizontal surface adapted to hold an infant or a pet in an elevated position, and a support structure supporting said holding structure adapted to hold said holding structure in an elevated position at least partially above an adult sleeping area wherein said holding means having an area substantially smaller than said adult sleeping area and is movable via a single step operation from a first position to a second position displaced both horizontally and vertically from said first position and wherein said horizontal surface is substantially horizontal throughout said single step operation.

13. The apparatus for providing a resting area for an infant or a pet according to claim 12, wherein said holding structure is vertically movable and adjustable between at least a first vertical position and a second vertical position above an adult sleeping area.

14. The apparatus for providing a resting area for an infant or a pet according to claim 13, wherein said support structure enables said holding structure to be selectively moved from at least a first X-Y plane position to at least a second position horizontally displaced from said first X-Y plane position.

15. The apparatus for providing a resting area for an infant or a pet according to claim 14, where said support structure comprises an arm extending from a stand, said arm being rotatable about a pivot point to enable said holding structure to be movable along at least a portion of an arc, and said holding structure being movable radially with respect to said arm.

16. The apparatus for providing a resting area for an infant or a pet according to claim 14, wherein said holding structure is rotatably movable about a vertical axis.

17. The apparatus for providing a resting area for an infant or a pet according to claim 14, wherein said holding structure is swingably movable.

18. The apparatus for providing a resting area for an infant or a pet according to claim 15, further comprising a vertical sleep area divider extending from said arm down to said adult sleeping area.

19. The apparatus for providing a resting area for an infant or a pet according to claim 15, further comprising a substantially horizontally positioned tray for holding supplies attached to said support structure.

20. The apparatus for providing a resting area for an infant or a pet according to claim 12, further comprising a light source attached to said support structure for lighting an area over the adult sleeping area.

21. The apparatus for providing a resting area for an infant or a pet according to claim 14, wherein said support structure includes a cam surface wherein movement of said holding structure horizontally causes simultaneous vertical movement of said holding structure.

22. The apparatus for providing a resting area for an infant or a pet according to claim 14, wherein said holding apparatus comprises a substantially horizontal rigid support rod which is supported by a receiving portion of said support structure and wherein said rod is horizontally movable with respect to said receiving portion.

23. The apparatus for providing a resting area for an infant or a pet according to claim 22, wherein said support structure is adapted to enable said holding structure to pivot about a vertical axis associated with said receiving portion, and wherein said rod is movable to a position in which the receiving portion is substantially above one side of said holding structure and said holding structure is rotatably movable between a first perpendicular position in which said holding structure is substantially above a first side of the adult sleeping area, a second perpendicular position in which said holding structure is substantially above a second side of the adult sleeping area, and a third parallel position in which said holding structure is substantially above a central portion of the adult sleeping area.

24. The apparatus for providing a resting area for an infant or a pet according to claim 12, wherein said holding structure further comprises flaps extending below a bottom surface of said holding structure to at least partially enclose a volume of air to enable temperature control.

25. The apparatus for providing a resting area for an infant or a pet according to claim 12, wherein said holding structure comprises a rigid upper rim and collapsible walls, wherein a bottom surface is capable of being moved vertically toward said upper rim via collapse of said walls to enable increased access to said holding structure.

26. The apparatus for providing a resting area for an infant or a pet according to claim 12, wherein said holding structure comprises a rigid bottom rim and collapsible walls, wherein a top rim of said holding structure is capable of being moved vertically toward said bottom rim via collapse of said walls to enable increased access to said holding structure.

27. The apparatus for providing a resting area for an infant or a pet according to claim 12, wherein said holding structure comprises at least one wall which enables manual opening of said wall to provide increased access to said holding structure.

28. The apparatus for providing a resting area for an infant or a pet according to claim 12, wherein said holding structure further comprises means for heating a portion of said holding structure.

29. The apparatus for providing a resting area for an infant or a pet according to claim 12, wherein said holding structure comprises a flexible bottom surface, and wherein an attachment point for said bottom surface to another portion of said holding structure is adjustable to enable a configuration of said bottom surface to be selectable.

* * * * *